US006390861B1

(12) United States Patent
DeFrance

(10) Patent No.: US 6,390,861 B1
(45) Date of Patent: May 21, 2002

(54) WEDGE TAP CONNECTOR AND ADAPTER FOR ENGAGING THE CONNECTOR FOR COOPERATION WITH A FIRE-ON TOOL

(75) Inventor: Robert DeFrance, Poughkeepsie, NY (US)

(73) Assignee: Delri LLC, Winsted, CT (US)

( * ) Notice: Subject to any disclaimer, the term of this patent is extended or adjusted under 35 U.S.C. 154(b) by 0 days.

(21) Appl. No.: 09/976,430

(22) Filed: Oct. 12, 2001

(51) Int. Cl.[7] ..... H01R 11/01
(52) U.S. Cl. ..... 439/783; 439/788; 439/836
(58) Field of Search ..... 439/783, 786, 439/787, 788, 820, 836

(56) References Cited

U.S. PATENT DOCUMENTS

| | | | | | |
|---|---|---|---|---|---|
| 3,280,856 | A | * | 10/1966 | Broske et al. | 140/113 |
| 3,329,928 | A | * | 7/1967 | Broske | 439/783 |
| 3,588,791 | A | * | 6/1971 | Polidori | 439/783 |
| 5,842,893 | A | * | 12/1998 | De Keyser | 439/783 |
| 5,928,039 | A | * | 7/1999 | Alder et al. | 439/783 |
| 6,120,334 | A | * | 9/2000 | Timsit et al. | 439/783 |
| 6,152,786 | A | * | 11/2000 | Perrin et al. | 439/783 |

* cited by examiner

*Primary Examiner*—Tulsidas Patel

(74) *Attorney, Agent, or Firm*—Alix, Yale & Ristas, LLP

(57) ABSTRACT

A connector for joining two associated electrical conductors which includes first and second J-shaped jaws. The first and second J-shaped jaws respectively include first and second generally cylindrical section shaped concave portions and respective first and second generally planar stem portions. The first and second generally planar stem portions are disposed in generally overlapping relationship with the first and second generally cylindrical section shaped concave portions disposed in opposed relationship. The connector further includes a spring to bias the first and second J-shaped jaws and to position the first and second generally cylindrical section shaped concave portions closer together. The connector also includes a wedge member having opposed first and second generally cylindrical section shaped concave portions. The wedge member is disposed intermediate the first and second generally cylindrical section shaped concave portions of the first and second J-shaped jaws. The first generally cylindrical section shaped concave portions of the wedge member and the first generally cylindrical section shaped concave portions of the first J-shaped jaw are dimensioned and configured for engagement with a first associated electrical conductor. The second generally cylindrical section shaped concave portions of the wedge member and the second generally cylindrical section shaped concave portions of the second J-shaped jaw are dimensioned and configured for engagement with a second associated electrical conductor.

19 Claims, 11 Drawing Sheets

WEDGE TAP CONNECTOR AND ADAPTER FOR ENGAGING THE CONNECTOR FOR COOPERATION WITH A FIRE-ON TOOL

BACKGROUND OF THE INVENTION

This invention relates to electric power transmission lines, electric pole line systems, overhead electric power distribution hardware and particularly to connectors for attaching to a line for connecting an electric power conductor to a tap conductor, such as the conductor typically extending from a utility pole to a residential or commercial building.

There are several types of connectors that are used for this type of connection. One connector is a bolted type connection. This connector has an advantage because it can catch, accept and engage conductors having a wide range of diameters. Disadvantages of the bolted connector include a relatively high-cost and a requirement that a specific torque be applied to the bolt to achieve a proper connection. Another prior art connector is the parallel groove connector. It has the same advantages and disadvantages as the bolted connector.

The other prior art type of connector to which this invention relates is a wedge connector. Typical known wedge connectors are installed by means of an explosive charge in a so-called fired-on method. This approach has the primary advantage that it provides a positive and very cost effective installation. Another advantage is that it cleans the conductor, as the internal wedge is forced inwardly. A significant disadvantage of the prior art wedge connector is that each connector must be manufactured for specific wire sizes or relatively narrow size ranges. In other words, for any variation in the diameter of either conductor that is attached to the connector, a specific unique wedge type connector is required. Because there is a great variety of conductors which require such connectors, users (such as utility companies) are required to maintain a very large inventory of each of many different sizes of connectors. Similarly, manufacturers and distribution entities must also maintain a large inventory of many different unique connectors. Maintaining a large inventory is not economically desirable for the consumer, the manufacturer, or the distributor. In addition, there is also a disadvantage for the manufacturer. Inherently the manufacturer must tool up to manufacture a large variety of different connectors each corresponding to the various combinations of wire sizes with which they may be used. Consequently, the manufacturer does not fully benefit from the economies of scale inherent in greater standardization in connectors.

Typical prior art wedge connectors employ a C-shaped member and a discrete wedge member that is driven into the C-shaped member after the conductors have been placed within the interior of the C-shaped member. A disadvantage to this construction, in addition to the disadvantage of not being able to accommodate a range of sizes, is that the discrete wedge member may be misplaced or even lost during installation. The vulnerability to less than ready availability of the wedge member is more than ordinary inconvenience because the typical connector of this type is commonly installed by a person working on a utility pole or a person working on a ladder on the side of a building.

Still another problem with the prior art apparatus is that the worker while attached to a utility pole well above ground level and while typically wearing thick and cumbersome safety gloves, must almost simultaneously position two discrete cables or conductors within the C-shaped member, position a wedge intermediate the two discrete cables, position a powder actuated tool in the engaged relationship with the wedge and the C-shaped member and then fire the powder actuated tool by striking a part thereof with a hammer. Thus, the worker requires substantial dexterity and coordination and expends significant efforts to achieve the desired connection.

SUMMARY OF THE INVENTION

An object of the invention is to provide a new and improved connector that is suitable for use with a relatively large range of conductor sizes.

Another object of the invention is to provide a connector that will enable a manufacturer to reduce the number of connectors of this general type so that production can be concentrated on a smaller number of unique types of connectors to thereby achieve economies of scale in the manufacture of the connector in accordance with the present invention.

A further object of the invention is to provide a connector that can be installed in an efficient manner and is especially suitable for installation on utility poles or elevated work sites.

A still further object of the invention is to provide a connector that can be provided to the end user as a unitary assembly with no parts that are easily separated and lost.

A yet further object of the invention is to provide apparatus that can be efficiently manufactured in a cost effective manner.

It has now been found that these and other objects of the invention may be attained in a connector for joining two associated electrical conductors which includes first and second J-shaped jaws. The first and second J-shaped jaws respectively include first and second generally cylindrical section shaped concave portions. The first and second J-shaped jaws have respective first and second generally planar stem portions. The first and second generally planar stem portions are disposed in generally overlapping relationship with the first and second generally cylindrical section shaped concave portions disposed in opposed relationship. The connector further includes a spring to bias the first and second J-shaped jaws and to position the first and second generally cylindrical section shaped concave portions closer together.

The connector also includes a wedge member having opposed first and second generally cylindrical section shaped concave portions. The wedge member is disposed intermediate the first and second generally cylindrical section shaped concave portions of the first and second J-shaped jaws. The first generally cylindrical section shaped concave portions of the wedge member and the first generally cylindrical section shaped concave portions of the first J-shaped jaw are dimensioned and configured for engagement with a first associated electrical conductor. The second generally cylindrical section shaped concave portions of the wedge member and the second generally cylindrical section shaped concave portions of the second J-shaped jaw are dimensioned and configured for engagement with a second associated electrical conductor.

In some forms of the invention the wedge member includes a slot for receiving the first and second generally planar stem portions.

The spring may be a compression coil spring. In some forms of the invention, the wedge member includes a slot, the slot is dimensioned and configured for receiving the first and second generally planar stem portions which are disposed in generally overlapping relationship.

BRIEF DESCRIPTION OF THE DRAWING

The invention will be better understood by reference the accompanying drawing in which.

DESCRIPTION OF THE PREFERRED EMBODIMENTS

Figure 1:
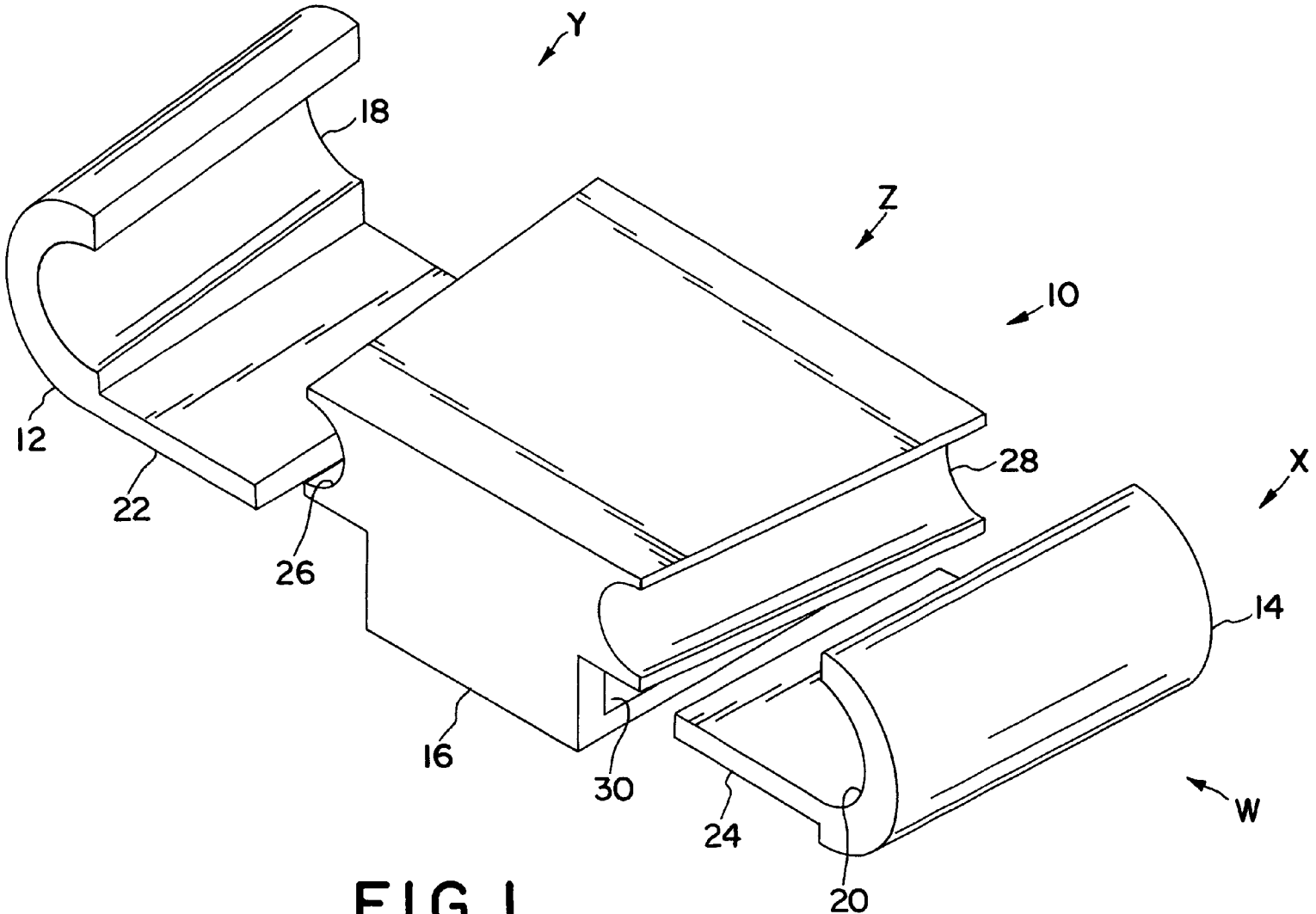
FIG. 1 is a simplified, exploded, partially broken away perspective view of a first embodiment of the apparatus in accordance with the present invention.
Figure 2:
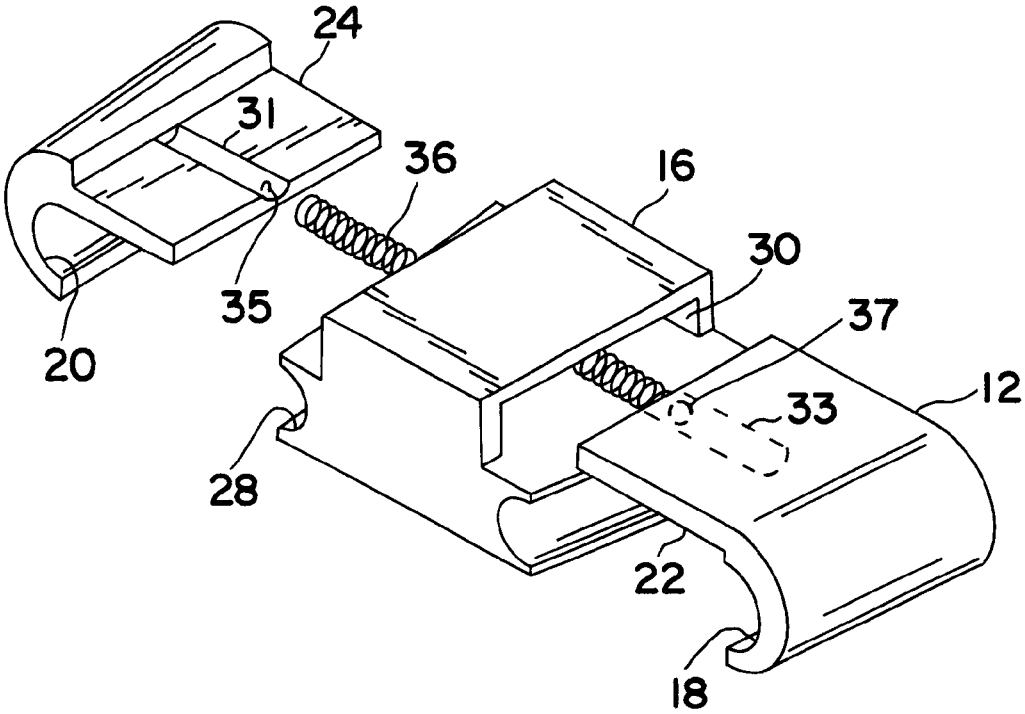
FIG. 2 is a simplified, exploded, partially broken away perspective view, similar to FIG. 1, illustrating the apparatus of FIG. 1 in a position that is inverted with respect to the position shown in FIG. 1.

Referring particularly to FIGS. 1 and 2, there is shown a wedge connector 10 in accordance with a first preferred form of the present invention. The views of FIGS. 1 and 2 are simplified. They show only the three main components, a first J-shaped jaw or clamp 12, a second J-shaped jaw or clamp 14 and a wedge member 16. The first and second J-shaped jaws 12, 14 have side surfaces thereof and sections that are generally J-shaped. In other words the sides of the J-shaped jaws 12, 14 have generally arcuate contours that are the edge of respective curvilinear surfaces 18, 20. The surfaces 18, 20 may each be described as concave and generally cylindrical section shaped. Each of the surfaces 18, 20 engage a generally cylindrical conductor in the normal operation of the connector 10.

To achieve the wedging action that is an essential aspect of the connector 10, the surfaces 18, 20 are not parallel. In the preferred embodiment the included angle intermediate the respective axes of the surfaces 18, 20 is approximately 20 degrees. Stated another way (as viewed in FIG. 1) the surface 20 is inclined toward a vertical plane (not shown) that bisects the wedge member 16, whereby the left (as viewed) axial extremity of the generally cylindrical section shaped surface 20 is closer to the same vertical plane (not shown) that bisects the wedge member 16. Similarly, the surface 18 is inclined toward the same vertical plane (not shown) that bisects the wedge member 16, whereby the left (as viewed in FIG. 1) axial extremity of the concave generally cylindrical section shaped surface 18 is closer to the same vertical (as viewed in FIG. 1) plane (not shown) that bisects the wedge member 16. Joined respectively to the curvilinear surfaces 18, 20 are generally planar portions 22, 24 that each have rectilinear edges.

The wedge member 16, in the preferred embodiment, is a single piece of metal having converging concave generally cylindrical section shaped surfaces 26, 28 disposed on opposed faces of the wedge member 16. To achieve the wedging action that is an essential aspect of the connector 10 the generally cylindrical section shaped surfaces 26, 28 are also not parallel. Instead they converge with an included angle between their respective axes of approximately 20 degrees. The left (as viewed in FIG. 1) axial extremities of the surfaces 26, 28 converge so as to be closer together as well as closer to a vertical plane (not shown) that bisects the wedge member 16. The surfaces 18 and 26 are dimensioned and configured for engagement with a first conductor A. Similarly, the surfaces 28 and 20 are dimensioned and configured for engagement with a second conductor B.

The wedge member 16 is provided with a slot 30 that is dimensioned and configured for receiving the generally planar portions 22, 24 of respectively J-shaped jaws 12, 14. More specifically, the generally planar portions 22, 24 extend in generally overlapping relationship within the slot 30. The slot 30 must necessarily have a width that is greater than the width of either of the generally planar portions 22, 24. This is necessary because at the time of final connection to the associated conductors A, B, the wedge member 16 is moved by a fire-on tool in the direction indicated by the arrow Z in FIG. 1. In other words, the wedge member 16 moves laterally with respect to the generally planar portions 22, 24 at the time of final connection with the conductors A, B.

As best seen in FIG. 2, the planar portions 22, 24 are provided with registered opposed channels 31, 33 that are dimensioned and configured for receiving a coil spring 36. The coil spring 36 exerts a force to bias the surfaces 18, 20 towards each other. As in the embodiment of FIGS. 4–6, the coil spring 36 is a compression spring. During the assembly operation for this embodiment the coil spring 36 is placed in the registered opposed channels 31, 33. Thereafter, a punch press is utilized to produce dimples 35, 37. These dimples 35, 37 are sufficient to stake or capture the ends of the spring 36. When the spring 36 is staked in this manner, the spring 36 will bias the surfaces 18, 20 towards each other.

Figure 6:
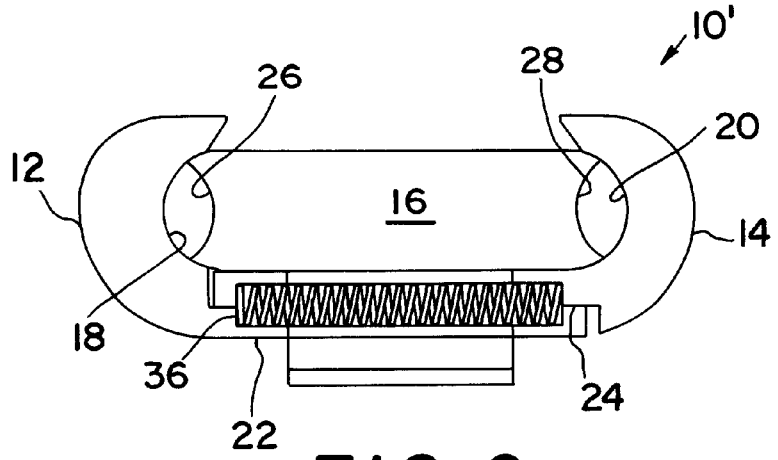
FIG. 6 is a partially sectional view of the apparatus illustrated in FIG. 4 illustrating the positions of the jaws thereof when no conductor is received by the connector.
Figure 5:
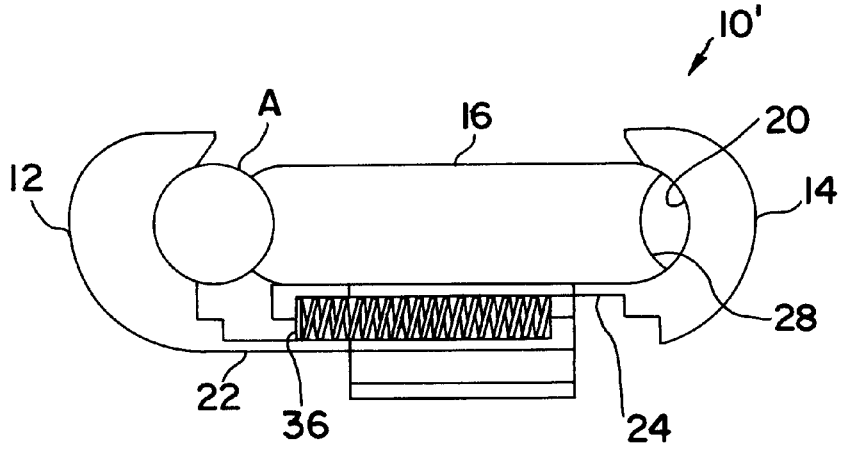
FIG. 5 is a partially sectional view of the apparatus in FIG. 4 illustrating the positions of the jaws thereof when the connector receives only one relatively large conductor.
Figure 4:
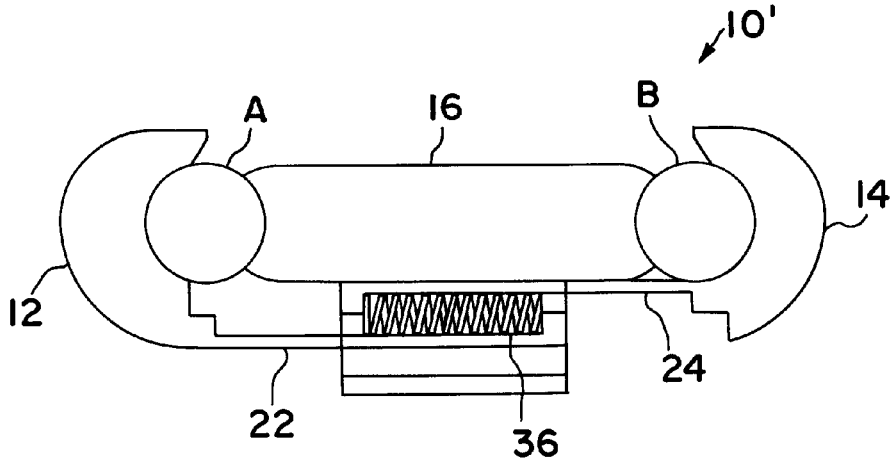
FIG. 4 is a partially sectional view of a second embodiment of the apparatus in accordance with the present invention illustrating the positions of the jaws thereof when the connector receives two relatively large conductors.

A similar preferred embodiment of the invention is illustrated in FIGS. 4–6 as wedge connector 10'. For simplicity in describing the wedge connector 10', the same reference numerals will be used to describe the elements of the second embodiment where the structural differences are minor. The wedge connector 10' also includes a first J-shaped jaw or clamp 12, a second J-shaped jaw or clamp 14 and a wedge member 16. The first and second J-shaped jaws 12, 14 have side surfaces thereof that are generally the J-shaped. In other words the sides of the J-shaped jaws 12, 14 have generally arcuate contours that are the edge of respective curvilinear surfaces 18, 20. The surfaces 18, 20 may each be described as concave and generally cylindrical section shaped. Each of the surfaces 18, 20 engage a generally cylindrical conductor in the normal operation of the connector 10'. To achieve the wedging action that is an essential aspect of the connector 10', the surfaces 18, 20 are not parallel. In the preferred embodiment the angle intermediate the respective axes of the surfaces 18, 20 is approximately 20 degrees. Stated another way, in FIG. 1 the surface 20 is inclined toward a vertical plane (not shown) that bisects the wedge member 16 whereby the left (as viewed) axial extremity of the generally cylindrical section shaped surface 20 is closer to the same vertical plane (not shown) that bisects the wedge member 16. Similarly, the surface 18 is inclined toward the same vertical plane (not shown) that bisects the wedge member 16 whereby the left (as viewed as viewed in FIG. 1) axial extremity of the concave generally cylindrical section shaped surface 18 is closer to the same vertical (as viewed in FIG. 1) plane (not shown) that bisects the wedge member 16. Generally, planar portions 22, 24 that have respective generally rectilinear edges are joined respectively to the curvilinear surfaces 18, 20.

The wedge member 16, is a single piece of metal, such as extruded aluminum impact extruded copper or cast copper having converging concave generally cylindrical section shaped surfaces 26, 28 disposed on opposed faces of the wedge member 16. To achieve the wedging action of the connector 10', the generally cylindrical section shaped surfaces 26, 28 are not parallel. Instead they converge with an included angle between their respective axes of approximately 20 degrees. The left (as viewed in FIG. 1) axial extremities of the surfaces 26, 28 converge so as to be closer together as well as closer to a vertical plane (not shown) that bisects the wedge member 16. The surfaces 18 and 26 are dimensioned and configured for engagement with a first conductor A. Similarly, the surfaces 28 and 20 are dimensioned and configured for engagement with a second conductor B, As best seen in FIGS. 4, 5 and 6, a coil compression spring 36 is disposed intermediate the generally planar portions 22, 24. Accordingly, the coil compression spring 36 biases the J-shaped jaws 12, 14 inwardly to the position illustrated in FIG. 6. By comparison of FIGS. 4, 5 and 6, it will be apparent that the coil compression spring 36 extends to its maximum possible length when the J-shaped jaws 12, 14 are disposed in abutting relationship to the generally cylindrical section shaped surfaces 26, 28 of the wedge member 16. In other words, the coil compression spring 36 extends to its maximum possible length when there is no conductor in place between either the surfaces 18 and 26 or the surfaces 28 and 20. The connector 10' in accordance with present invention is capable of accommodating a single conductor A as shown in FIG. 5, or two conductors of the same size as shown in FIG. 5. Alternatively, the connector 10' is capable of engaging a large range of individual conductors in place of the conductor A shown in FIG. 4, as well as a large range of individual conductors in place of the conductor B shown in FIG. 4.

Figure 9:
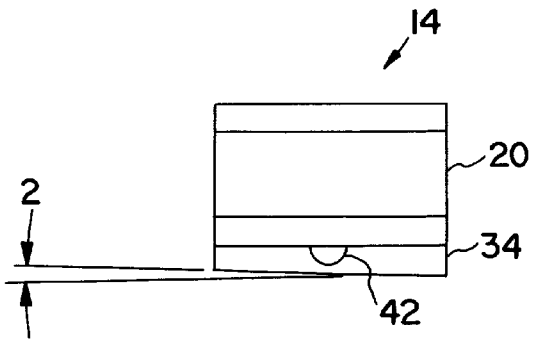
FIG. 9 is a side elevation view, partly in schematic, of the first jaw illustrated in FIG. 7.
Figure 10:
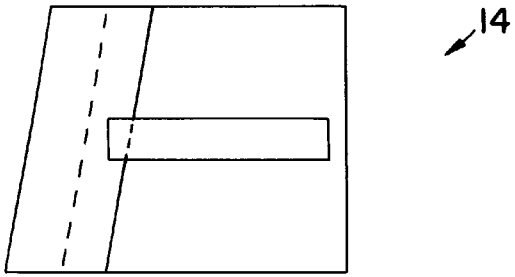
FIG. 10 is a top view, partly in schematic, of the first jaw illustrated in FIG. 7.
Figure 8:
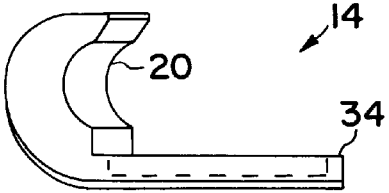
FIG. 8 is a front elevation, partly in phantom, view of the first jaw illustrated in FIG. 7.
Figure 7:
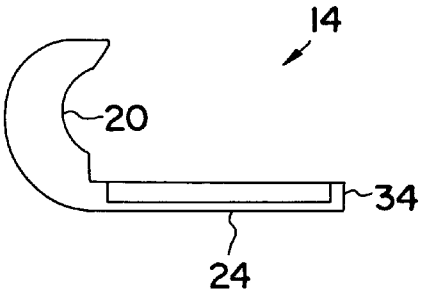
FIG. 7 is a sectional view of a first jaw of the connector illustrated in FIGS. 1 and 2
Figure 13:
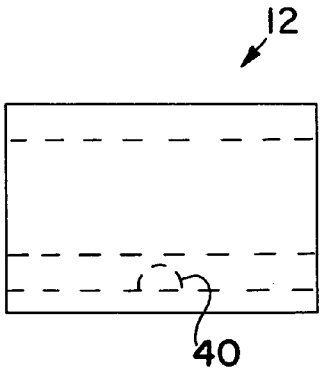
FIG. 13 is a side elevation view, partly in phantom, of the second jaw illustrated in FIG. 11.
Figure 14:
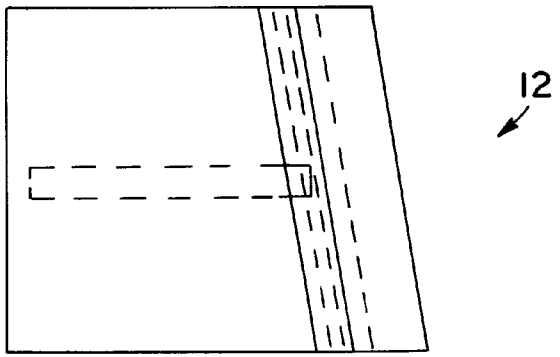
FIG. 14 is a top view, partly in phantom, of the second jaw illustrated in FIG. 11.
Figure 12:
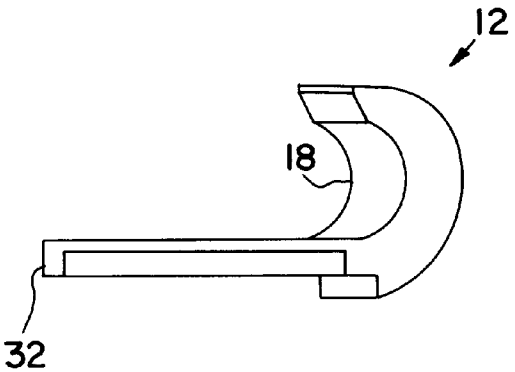
FIG. 12 is a front elevation view of the second jaw illustrated in FIG. 11.
Figure 11:
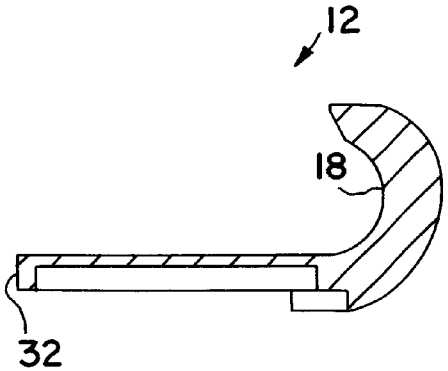
FIG. 11 is a sectional view of a second jaw of the connector illustrated in FIGS. 1 and 2.
Figure 15:
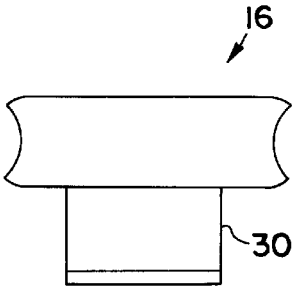
FIG. 15 is a front elevation view of the wedge member illustrated in FIGS. 1 and 2.
Figure 16:
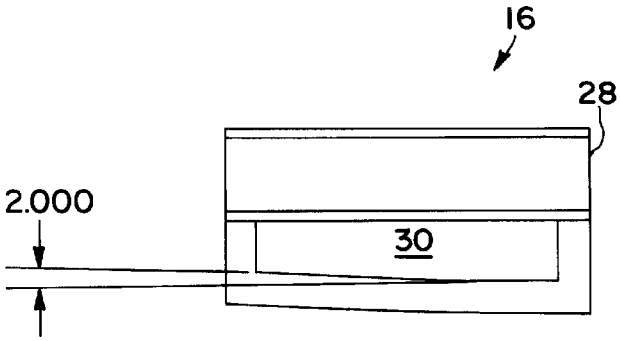
FIG. 16 is a side elevation view, partly in schematic, of the wedge member illustrated in FIG. 15.

More specific information as to the construction of the J-shaped jaws 12, 14 as well as the wedge member 16 is apparent by reference to FIGS. 7–16. The J-shaped jaw 14 is illustrated in greater detail in FIGS. 7–10 which are respectively cross-section, front, side and top views of this jaw 14. More particularly, the front view of FIG. 8 is a view taken in the direction indicated by the arrow X in FIG. 1. The J-shaped jaw 12 is illustrated in greater detail in FIGS. 11–14 which are respectively cross-section, front, side and top views of the jaw 12. More particularly, the front view in FIG. 12 is a view taken in the direction indicated by the arrow Y in FIG. 1. FIG. 13 shows in phantom line a semicircular notch 40 that is necessary to accommodate the compression spring 36. FIG. 9 illustrates a recess 42 that is also provided to accommodate the spring 36. These figures illustrate the angular orientation of the surfaces 18 and 20. FIGS. 15 and 16 are respectively from end side views of the wedge member 16 and the view of FIG. 15 is a view taken in the direction of the arrow Z of FIG. 1. The view of FIG. 16 is a side view taken in the direction of the arrow W in FIG. 1. This view illustrates the two degree taper in both the upper planar surface and the lower planar surface of the slot 30 which accommodates the generally planar portions 22, 24. In other words the slot 30 has a progressively smaller height. Thus, upon lateral movement of the meshed planar portions 22, 24 in response to the impact or induced by a fire on tool are forced closer together. This taper together with the convergence of the surfaces 18, 20 and 26, 28 produces the desired locking action on associated conductors located respectively intermediate the surfaces 20, 28 and/or the surfaces 18, 26.

Prior to shipment of the connector 10 in accordance with the invention, the J-shaped jaws 12, 14; wedge member 16; and the compression spring 36 are fully assembled in the manner illustrated in FIG. 6. It will be seen that the assembly is unitary and that there are no loose parts. This construction avoids the risk of loss of discrete parts as the case for some prior art structures. This construction also enables a worker to merely spread the J-shaped jaws 12, 14 to overcome the bias of the compression spring 36 and make an initial attachment to each of two conductors in the manner illustrated in FIG. 4.

Figure 3:
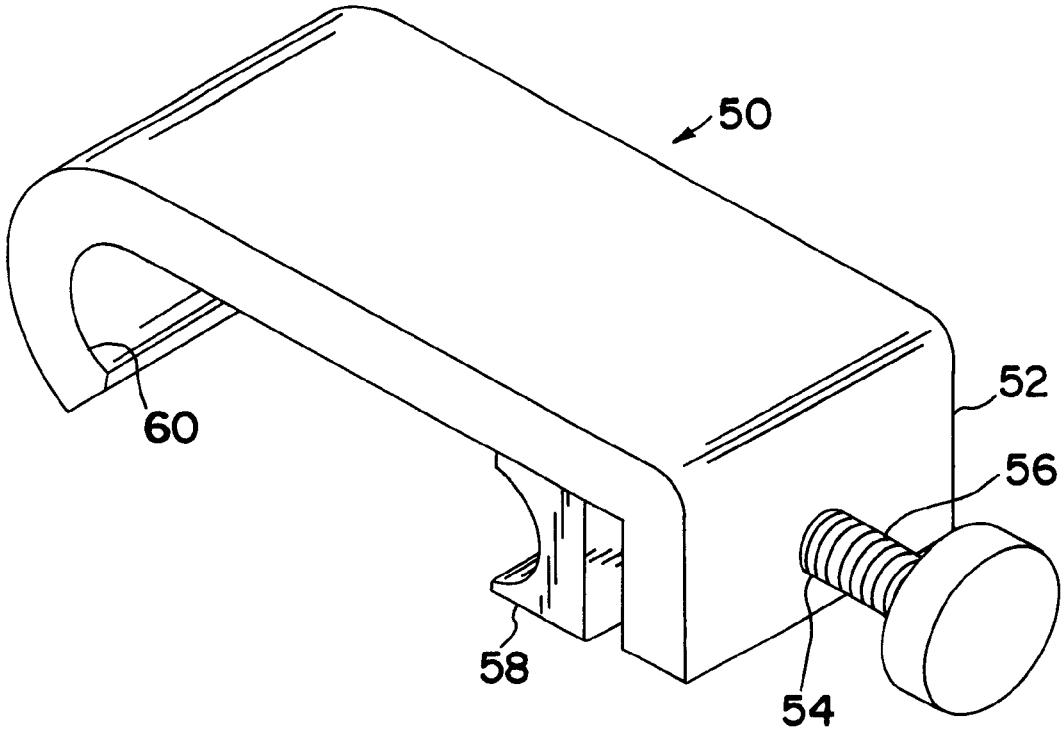
FIG. 3 is a perspective view of a tool that is used to install the connector illustrated in FIGS. 1 and 2.

When the installer has made this initial attachment to the conductors the next steps in accomplishing the final connection is to secure the tool 50, illustrated in FIG. 3. Tool 50 comprises a C-shaped body 52 having a threaded bore 54 that is engaged by a turnscrew 56 that is fixed to a movable jaw 58. In preparation for the use of the fire-on tool 60 illustrated in FIG. 17, the jaw 60 of the C-shaped body 52 and a movable jaw 58 are tightly secured around the exterior surface of the J-shaped jaws 12, 14. Thereafter the combination of the tool 50 and the connector 10 is placed within the industry standard fire-on tool 60. The fire-on tool 60 is positioned appropriately to impart a substantial force in the direction indicated by the arrow Z in FIG. 1. The combination of the converging surfaces 18, 26, 28, 20 together with the converging surface of the slot 30 together with the substantial force exerted by the fire-on tool results in a positive blocking attachment to the conductors A, B. The installer will then disengage the fire-on tool 60 and the tool 50 from the connector 10 and proceed to the next task.

In a typical application, the spring 36 will have a spring constant of about 8–14 pounds/inch, an outside diameter of 0.25", and a solid height of 0.625". The preferred embodiments of the invention preferably include means for limiting relative motion between the first and second J-shaped jaws 12, 14. More specifically, the means for limiting relative motion limits relative motion so that relative motion occurs only in a single direction. For example, as best seen in FIG. 2, the relative motion between the J-shaped jaws 18, 20 is in a direction that is substantially coincident with the axis of the spring 36. In the embodiment of FIG. 2, the means for limiting relative motion includes the registered opposed channels 31, 33 that are dimensioned and configured for receiving a coil spring 36. The dimensioning of the slot 30 keeps the generally planar portions 22, 24 in face abutting aligned relationship. The dimensioning of the spring 36 relative to the dimensioning of the registered opposed channels 31, 33 that are within the face abutting planar portions 22, 24 insures that substantially all relative movement between the first and second J-shaped jaws is in a direction that is parallel to the axis of the spring 36.

The apparatus may include a ball or an axial part of a cylinder at each axial extremity of the spring 36 to ensure that the alignment between the jaws will be maintained and unidirectional relative movement of the jaws. Preferably, the cylinder or ball will have a diameter substantially equal to the diameter of the spring 36. Thus, the cylinder or ball will register with the opposed channels 31, 33 and maintain proper alignment between the planar portions 22, 24. In some embodiments a punch press will place a dimple within each opposed channels 31, 33 to limit the maximum travel of the ball or cylindrical section. The ball is the preferred construction.

Referring now to FIGS. 18–39 there is shown a third preferred embodiment designated at connector 110. The connector 110 has substantial similarities to connector 10; however, there are some significant differences. The structure includes a wedge member 116, a first J-shaped member 122 and a second J-shaped member 124. All of the angular relationships described with respect to the first and second embodiment are present in the third embodiment.

In the third embodiment, the J-shaped jaws 122, 124 preferably include elongated T-shaped handles 117, 119 at the outboard extremities respectively of the J-shaped jaws 122, 124. It will be understood that the connector 110 may be utilized by a worker positioned at the top of a utility pole, utilizing heavily insulated thick gloves to attach a power connection and electrical power may be present on the cables being connected. Accordingly, the addition of the key-shaped handles 117, 119 is particularly advantageous. The wedge member 116 is further provided with a counterbore 121 that is dimensioned and configured for registration with the pin 123 of the fire-on tool 60. This registration ensures proper alignment.

FIGS. 7, 8, 9 and 10 illustrate first jaw 14 of the connector 10. FIGS. 21–24 illustrate the first jaw 122 of the connector 110. Just as the first jaw 14 is provided with a channel 42 for engagement with a spring 36 with a ball or cylindrical section at each axial extremity to maintain alignment of the channels 40, 42, the corresponding first jaw 122 includes a channel 142 for engagement with a spring 136 and balls 137 disposed at each axial extremity of the spring 136. Typically, a punch press will position at least one dimple within the channel 142 to limit the maximum travel of at least one of the balls 137. As noted above, all of the angular relationships described with respect to the first jaw 14 of the connector 10 are also present in the first jaw 122 of the connector 110.

Similarly, FIGS. 33–38 illustrate the second jaw of the connector 110 that corresponds to the second jaw 12 of the connector 10 illustrated in FIGS. 11–14. Just as the second jaw 12 of the connector 10 is provided with a channel 40, the second jaw 124 of the connector 110 is provided with a channel 140 for engagement with the spring 136 and balls 137 disposed at each axial extremity of the spring 136. As in the case of the jaw 12, a punch press will typically be utilized to produce a dimple within the channel 140 to limit the maximum travel of one or both of the balls 137. As noted above, all of the angular relationships described with respect to the second jaw 12 of the connector 12 apply to the second jaw 124 of the connector 110.

Figure 27:
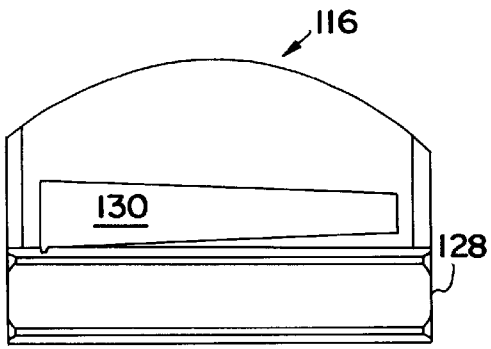
FIG. 27 is a side elevation view of the wedge member of the third preferred embodiment.
Figure 30:
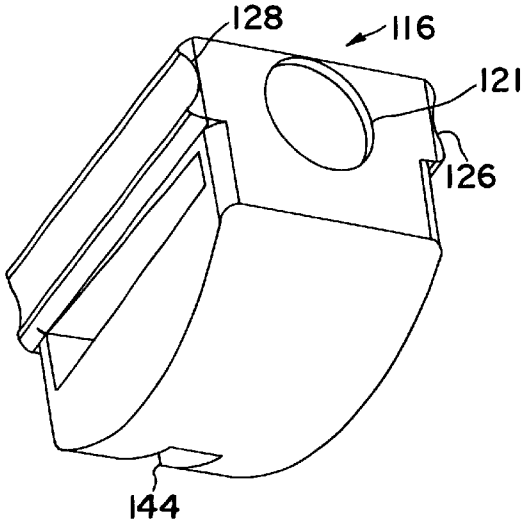
FIG. 30 is an isometric view of the wedge member illustrated in FIGS. 27, 28 and 29.
Figure 28:
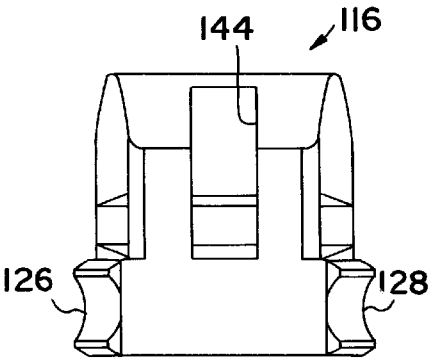
FIG. 28 is a front elevation view of the wedge member illustrated FIG. 27.
Figure 35:
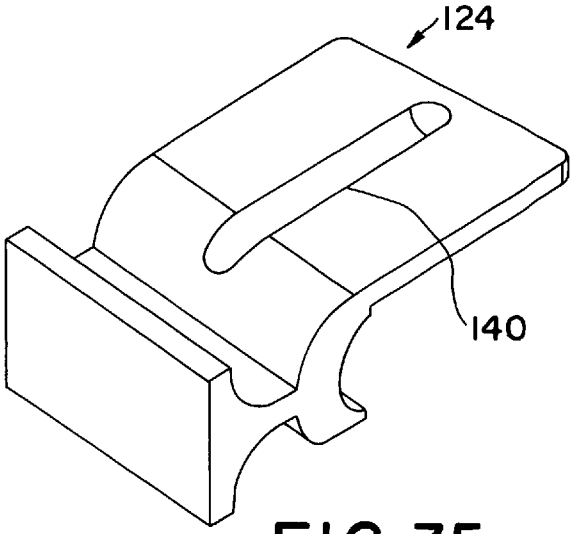
FIG. 35 is another isometric view of the second J-shaped jaw in the third preferred embodiment.
Figure 34:
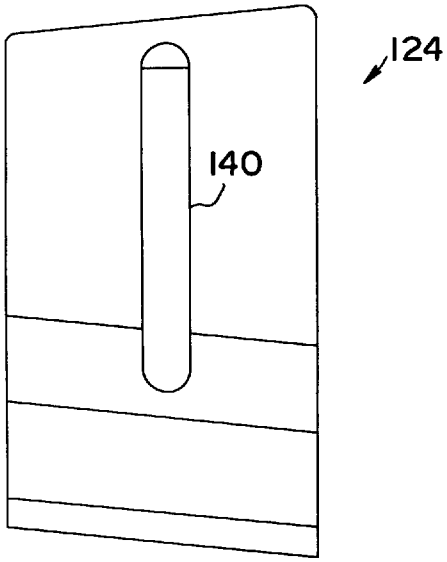
FIG. 34 is a bottom plan view of the second J-shaped jaw in the third preferred embodiment.
Figure 33:
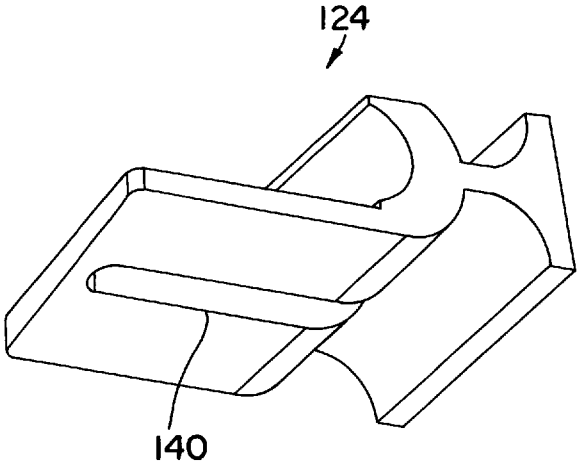
FIG. 33 is an isometric view of the second J-shaped jaw in the third preferred embodiment.
Figure 38:
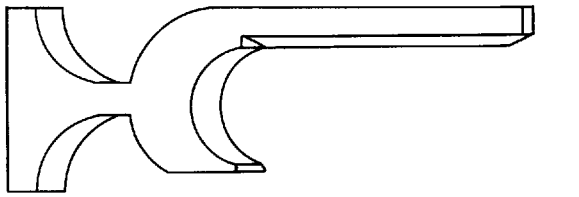
FIG. 38 is a right side elevation view of the second J-shaped jaw in the third preferred embodiment.
Figure 37:
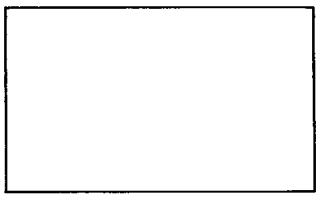
FIG. 37 is a rear elevation view of the second J-shaped jaw in the third preferred embodiment.
Figure 36:
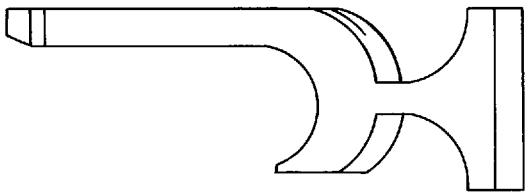
FIG. 36 is a left side elevation view of the second J-shaped jaw in the third preferred embodiment.
Figure 39:
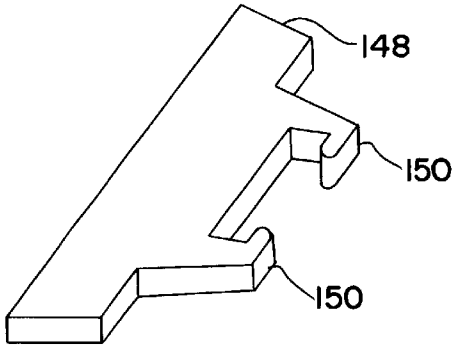
FIG. 39 is an isometric view of the retainer clip provided to position the J-shaped jaws within the wedge member.
Figure 40:
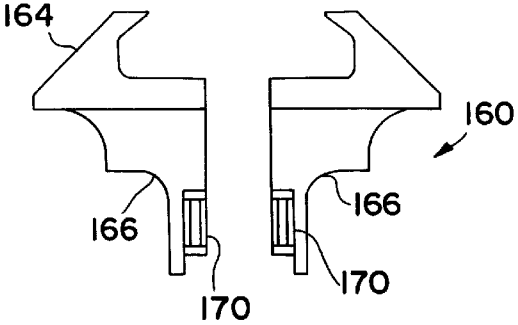
FIG. 40 is a front elevation view of a tool or adapter for use with the industry standard fire-on tool illustrated in FIG. 17.
Figure 41:
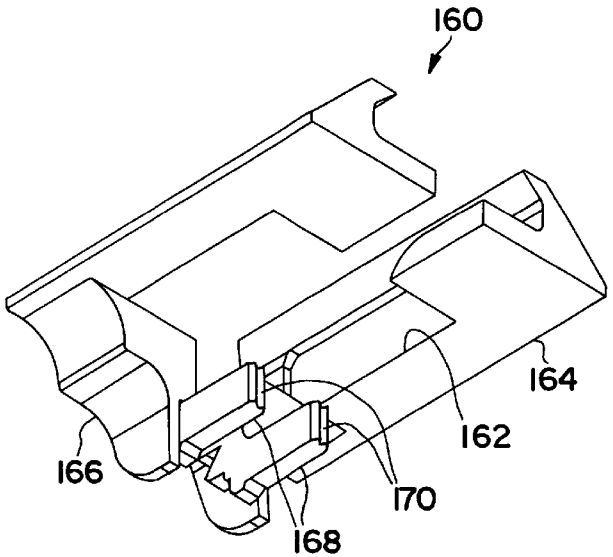
FIG. 41 is an isometric view of the adapter illustrated in FIG. 40.
Figure 42:
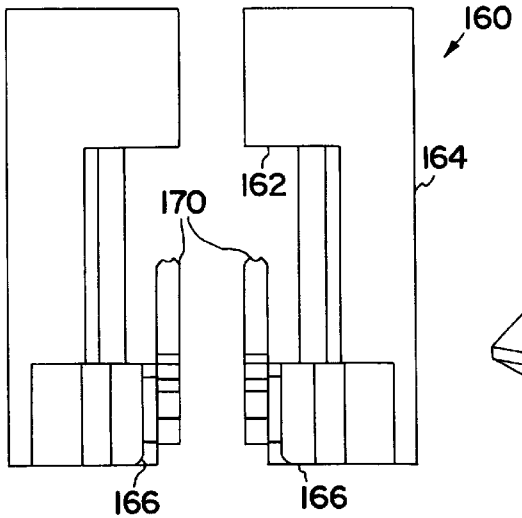
FIG. 42 is a top plan view of the adapter illustrated in FIGS. 40 and 41.
Figure 43:
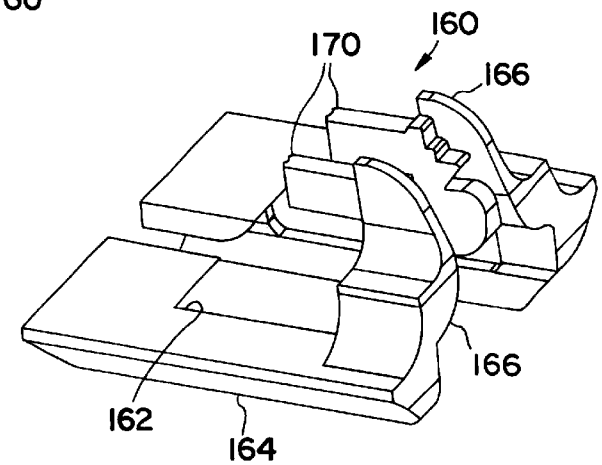
FIG. 43 is another isometric view of the adapter illustrated in FIGS. 40, 41 and 42.

The wedge member 116, illustrated in FIGS. 27–32, of the connector 110 is similar, particularly with respect to angular relationships to the wedge member 16 of the connector 10 illustrated in FIGS. 1, 15 and 16. Just as the wedge member 16 includes a slot 30, the wedge member 116 includes a slot 130. Similarly, just as the wedge member 16 includes converging generally cylindrical surfaces 26, 28, best seen in FIG. 6, the wedge member 116 includes converging generally cylindrical surfaces 126, 128. The wedge member 116 includes an opening 144 that provides access to the interior of the wedge member 116 to allow the tooling or adapter illustrated in FIGS. 40-43 in cooperation with the fire-on tool 60 illustrated in FIG. 17 to lock the jaws 122, 124 in place against the received cables. The slot 130 is laterally tapered as best seen in FIG. 27. The slot 130 has a lateral extent that is greater than the lateral extent of the jaws 122, 124. Accordingly, the initial placement of the jaws 122, 124 is at the left side (as viewed in FIG. 27) of the slot 130. In this position the worker is able to extend the jaws against the spring force imposed by the spring 136 to engage the respective cables. Once the cables are engaged, the spring 136 will maintain the connection and avoid the necessity for the worker to juggle discrete pieces of a clamp and two cables as in the prior art devices.

In an additional optional feature of the invention, a device is employed to avoid inadvertent locking of the connector 110. More specifically, it is desirable to avoid any possibility of vibration causing lateral movement of the jaws 122, 124 toward the right side (as viewed in FIG. 27) of the slot 130. The connector 110 may utilize a pin or spacer 148, typically manufactured of plastic and having relatively flexible arms 150, that is inserted in the right side of the slot (as viewed in FIG. 27). This pin or spacer is installed at the time of manufacture of the connector 110 with the arms 150 gripping the right side (as viewed in FIG. 27) wall of the slot 130. This spacer 148 is intended to be so positioned until the worker is ready to complete the final connection step with the two separate cables. At that time or shortly thereafter when the worker has engaged the connector 110 with the adapter 160 illustrated in FIGS. 40–43, the worker will remove this spacer by grasping the axial extremity of the spacer 148, pulling on the axial extremity of the spacer 148 and bending the relatively flexible arms 150 to withdraw the spacer completely from the slot 130.

Figure 17:
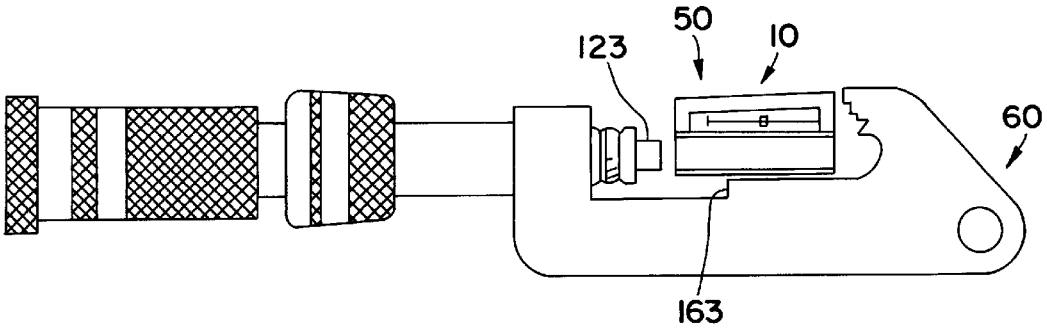
FIG. 17 is an elevation view of the connector illustrated in FIG. 12 and disposed within an industry standard fire-on tool.
Figure 18:
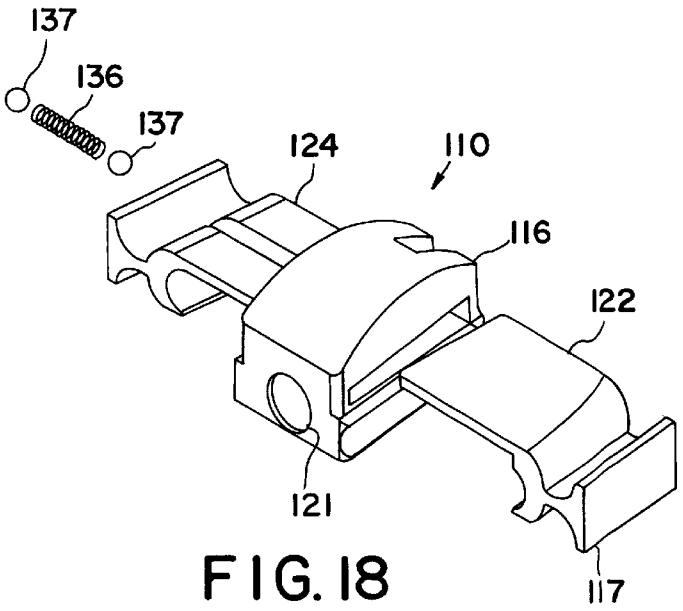
FIG. 18 is an exploded isometric view of the third preferred embodiment of the connector in accordance with the present invention.
Figure 19:
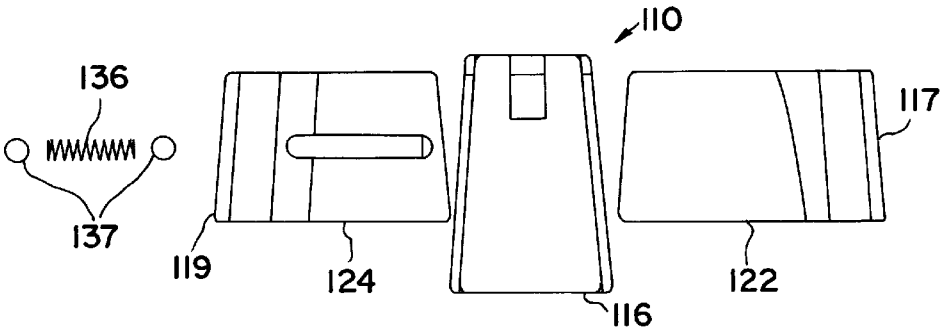
FIG. 19 is an exploded top plan view of the third preferred embodiment.
Figure 20:
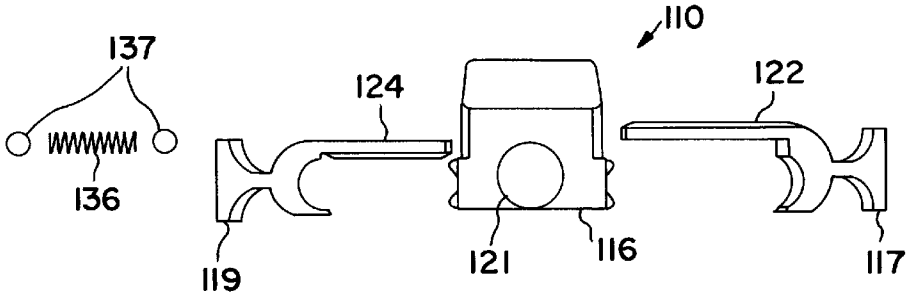
FIG. 20 is an exploded elevation view of the third preferred embodiment.
Figure 21:
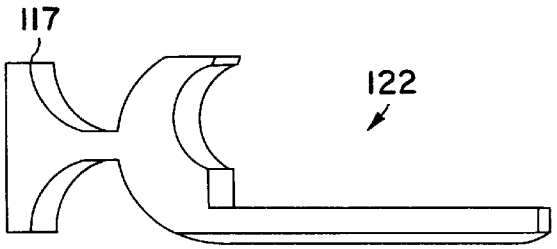
FIG. 21 is a left side elevation view of a first J-shaped jaw in the third preferred embodiment.
Figure 22:
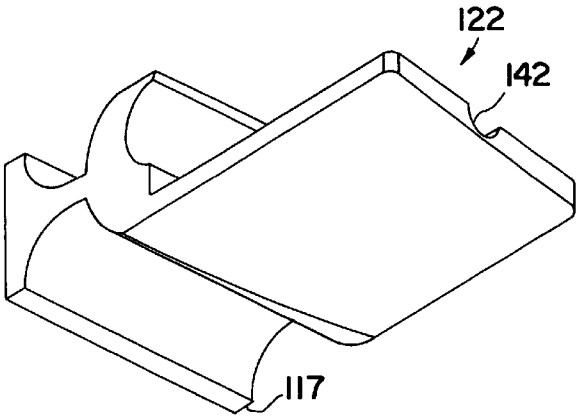
FIG. 22 is an isometric view of the first J-shaped jaw illustrated in FIG. 21.
Figure 23:
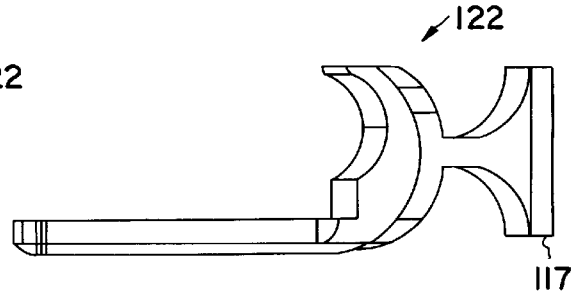
FIG. 23 is a right side elevation view of the first J-shaped jaw in the third preferred embodiment illustrated in FIGS. 21 and 22.
Figure 24:
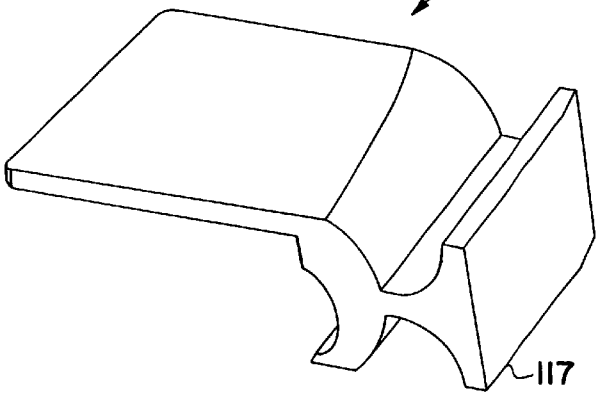
FIG. 24 is an isometric view of the first J-shaped jaw illustrated in FIGS. 21, 22 and 23.
Figure 25:
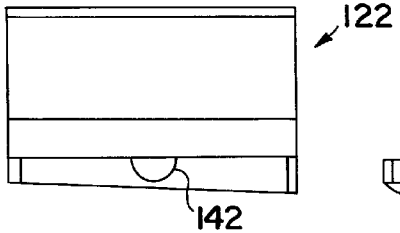
FIG. 25 is a front elevation view of the second J-shaped jaw illustrated in FIGS. 22, 23 and 24.
Figure 26:
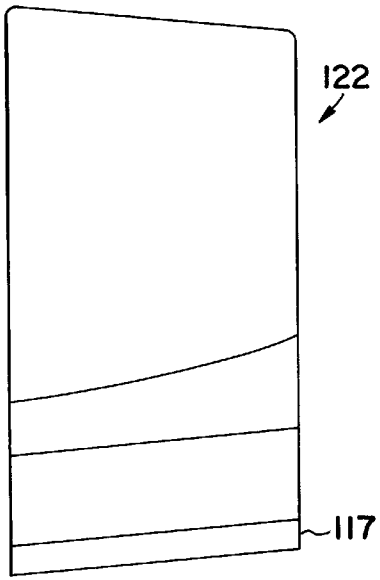
FIG. 26 is a top plan view of the second J-shaped jaw illustrated in FIGS. 23, 24 and 25.
Figure 32:
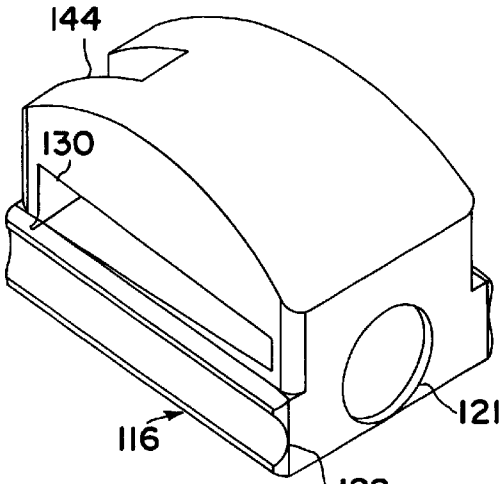
FIG. 32 is another isometric view of the wedge member illustrated in FIGS. 27, 28, 29, 30 and 31.
Figure 29:
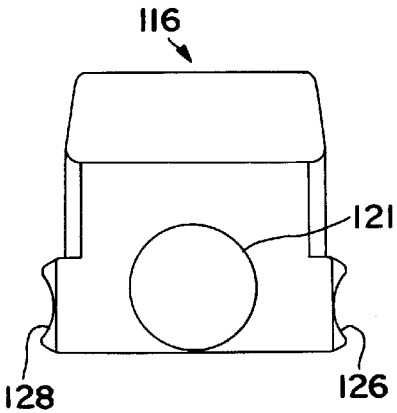
FIG. 29 is a rear elevation view of the wedge member illustrated in FIGS. 27 and 28.
Figure 31:
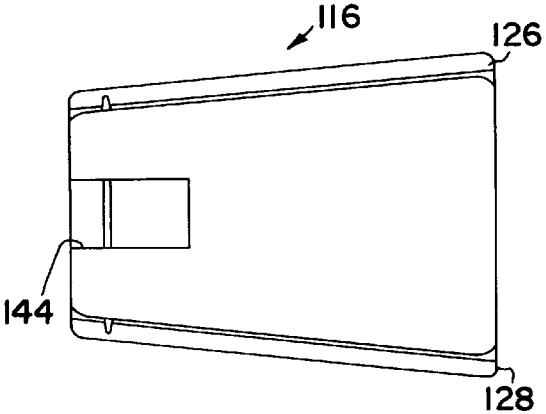
FIG. 31 is a top plan view of the wedge member illustrated in FIGS. 27, 28, 29 and 30.

Typically the worker will place the adapter 160 (illustrated in FIGS. 40–43) on a fire-on tool 60 (FIG. 17). Such tools are available from a number of manufacturers. One such tool is manufactured by Amp Products Corporation of Valley Forge, Pa. and marketed under the trademark AMPACT and described as a powder-actuated tool intended for the application of taps and stirrups.

The adapter 160 includes a substantially square opening 162 that is dimensioned and configured for engagement with a surface 163 that is part of the fire-on tool 60. This mating relationship together with threaded fasteners fixes the adapter 160 to the fire-on tool 60. The adapter includes a base 164 that includes the opening 162. Upstanding supports 166 support respective rigid arms 168. Each arm 168 carries respective pairs of generally perpendicular parallel chisel edges 170. The arms 168 with the chisel edges 170 are dimensioned and configured to extend into the opening 144 so that the chisel edges 170 engage the sides of the J-shaped jaws 122, 124. More particularly, the chisel edges are disposed in substantially perpendicular relationship to the planar stems of the J-shaped jaws 122, 124. Thus, the chisel edges 170 at the instant of firing of the fire-on tool 60 grip one side of each of the J-shaped jaws 122 in a manner that reduces any tendency for the jaws 122, 124 to move in a manner that would allow release of the cables being gripped by the connector 110.

While the present invention has been described with reference to the preferred embodiments illustrated in the drawing, the detailed description thereof is not intended to limit the scope of the invention as claimed in the appended claims.

What is claimed is:

1. A connector for electrically connecting two associated electrical conductors which connector comprises:

first and second J-shaped jaws, said first and second J-shaped jaws respectively including first and second generally cylindrical section shaped concave portions, said first and second J-shaped jaws having respective first and second generally planar stem portions, said first and second generally planar stem portions being disposed in generally overlapping relationship with said first and second generally cylindrical section shaped concave portions being disposed in opposed relationship;

spring bias means biasing said first and second jaws to urge said first and second generally cylindrical section shaped concave portions toward each other; and a wedge member defining a slot therein, said slot having a lateral extent greater than the lateral extent of said first and second generally planar stem portions, said slot having a height that tapers laterally in a first direction from a first height that allows substantially free relative motion between said overlapping first and second generally planar stem portions to a second height that does not allow relative motion between said overlapping first and second generally planar stem portions, said wedge member having opposed first and second generally cylindrical section shaped concave portions, said wedge member being disposed intermediate said first and second generally cylindrical section shaped concave portions of said first and second J-shaped jaws, said first generally cylindrical section shaped concave portions of said wedge member and said first generally cylindrical section shaped concave portions of said first J-shaped jaw being dimensioned and configured for engagement with a first associated electrical conductor, said second generally cylindrical section shaped concave portions of said wedge member and said second generally cylindrical section shaped concave portions of said second J-shaped jaw being dimensioned and configured for engagement with a second associated electrical conductor, so that a force applied to said stem portions in said first direction moves said stem portions toward the heart of said slot that has said second height for wedging engagement to securely connector the two associated electrical conductors between respective generally cylindrical section shaped concave portions.

2. A connector in accordance with claim 1, wherein said spring bias means is a coil spring.

3. A connector in accordance with claim 2, wherein said coil spring is a compression spring.

4. A connector in accordance with claim 3, wherein said slot is dimensioned and configured for receiving said first and second generally planar stem portions disposed in generally overlapping relationship.

5. A connector in accordance with claim 4, wherein the free ends of the first and second generally planar stem portions each include a first and second means for capturing a spring.

6. A connector in accordance with claim 2, wherein said coil spring is disposed intermediate said first and second means for capturing a spring.

7. A connector in accordance with claim 6, wherein said first and second means for capturing a spring extend in coaxial relationship.

8. A connector in accordance with claim 7 wherein said first and second means each include a cylindrical section shaped channel.

9. A connector in accordance with claim 8 wherein a stop member is disposed at each axial extremity of said spring.

10. A connector in accordance with claim wherein each of said stop member's is disposed within said cylindrical section shaped channels.

11. A connector in accordance with claim 10 wherein each of said stop members is a ball.

12. A connector in accordance with claim 1 wherein each of said J-shaped jaws and includes a handle.

13. A connector in accordance with claim 12 wherein each of said handles has a T-shaped cross-section.

14. A connector in accordance with claim 1 wherein said wedge member includes a counterbore dimensioned and configured for engagement with an associated fire-on tool.

15. A connector in accordance with claim 1 wherein said wedge member includes an opening extending into said slot so that a force can be applied to said stem portions to move said stem portions laterally within said slot from a portion thereof having a first height toward a portion having a second height.

16. A connector in accordance with claim 2 further including a spacer dimensioned and configured for placement within said slot inside abutting relationship to said first and second generally planar stem portions to prevent lateral movement, said spacer being dimensioned configured to be removable.

17. A connector for electrically connecting two associated electrical conductors which connector comprises:

first and second jaws, said first and second jaws respectively including first and second concave portions, said first and second jaws having respective first and second stem portions, said first and second stem portions being disposed in generally overlapping relationship with said first and second concave portions disposed in opposed relationship;

spring bias means biasing said first and second jaws to position said first and second concave portions toward each other; and a wedge member receiving said first and second jaws in a tapered slot and having opposed first and second concave portions, said wedge member being disposed intermediate said first and second concave portions of said first and second jaws, said first concave portion of said wedge member and said first concave portions of said first jaw being dimensioned and configured for engagement with a first associated electrical conductor, said second concave portions of said wedge member and said second shaped concave portions of said second jaw being dimensioned and configured for engagement with a second associated electrical conductor.

18. A connector for electrically connecting two associated electrical conductors which connector comprises:

first and second jaws, said first and second jaws respectively including first and second channel shaped concave portions, said first and second jaws having respective first and second planar stem portions, said first and second planar stem portions being disposed in generally overlapping relationship with said first and second channel shaped concave portions disposed in opposed relationship;

spring bias means biasing said first and second jaws to urge said first and second channel shaped concave portions toward each other; and a wedge member receiving said first and second jaws and having opposed first and second channel shaped concave portions, said first and second channel shaped concave portions having respective first and second axes, said first and second axes being disposed in converging relationship, said wedge member being disposed intermediate said first and second channel shaped concave portions of said first and second jaws, said first channel shaped concave portions of said wedge member and said first channel shaped concave portions of said first jaw being dimensioned and configured for engagement with a first associated electrical conductor, said second channel shaped concave portions of said wedge member and said second channel shaped concave portions of said second jaw being dimensioned and configured for engagement with a second associated electrical conductor and means for producing wedging engagement between said first and second planar stem portions to prevent relative motion therebetween.

19. A connector in accordance with claim 18, wherein said first and second jaws include cooperating means therebetween that limits relative motion between said first and second jaws to a single direction.

* * * * *